US011629569B2

(12) United States Patent
Fairweather

(10) Patent No.: US 11,629,569 B2
(45) Date of Patent: Apr. 18, 2023

(54) SYSTEM AND METHOD FOR MOVING STUCK OBJECTS IN A WELL

(71) Applicant: Ardyne Holdings Limited, Aberdeen (GB)

(72) Inventor: Alan Fairweather, Aberdeen (GB)

(73) Assignee: ARDYNE HOLDINGS LIMITED, Aberdeen (GB)

( * ) Notice: Subject to any disclaimer, the term of this patent is extended or adjusted under 35 U.S.C. 154(b) by 169 days.

(21) Appl. No.: 17/294,464

(22) PCT Filed: Nov. 13, 2019

(86) PCT No.: PCT/GB2019/053211
§ 371 (c)(1),
(2) Date: May 17, 2021

(87) PCT Pub. No.: WO2020/104771
PCT Pub. Date: May 28, 2020

(65) Prior Publication Data

US 2022/0010642 A1 Jan. 13, 2022

(30) Foreign Application Priority Data

Nov. 21, 2018 (GB) ..... 1818933
Apr. 11, 2019 (GB) ..... 1905142

(51) Int. Cl.
*E21B 31/113* (2006.01)
*E21B 23/04* (2006.01)
(Continued)

(52) U.S. Cl.
CPC ..... *E21B 31/1135* (2013.01); *E21B 23/04* (2013.01); *E21B 23/0411* (2020.05);
(Continued)

(58) Field of Classification Search
CPC ..... E21B 31/107; E21B 31/113; E21B 23/01; E21B 23/0411
See application file for complete search history.

(56) References Cited

U.S. PATENT DOCUMENTS 2,153,882 A 4/1939 Erwin
2,915,126 A 12/1959 Potts
(Continued)

FOREIGN PATENT DOCUMENTS

CN 107091064 A 8/2017
EP 2085570 A2 8/2009
(Continued)

OTHER PUBLICATIONS

European Patent Office as International Search Authority; International Search Report and Written Opinion for PCT/GB2019/053211; dated Feb. 7, 2020; all pages; European Patent Office, Rijswijk, The Netherlands.
(Continued)

*Primary Examiner* — Robert E Fuller
(74) *Attorney, Agent, or Firm* — Law Office of Jesse D. Lambert, LLC

(57) ABSTRACT

A thru-tubing recover string (10) and method of moving a stuck object (14) in tubing in a well (16). A bottom hole assembly (22) is connected to a work string and includes a first (32) and a second tool (34), each tool configured to apply a force to the object in order to move the object (14), the first force being an impulse force, the second force being a static force, and the tools being operable independently so that an operator can apply either force in the event that application of one type of force on the object fails to move the object. Embodiments are described for the first tool (32) being a hammer tool or a jar and the second tool being a pulling tool such as a jack. The invention finds application in removing stuck objects such as plugs or actuating elements on tools such as sliding sleeves in production tubing.

20 Claims, 4 Drawing Sheets

(51) Int. Cl.

| | |
|---|---|
| ***E21B 31/107*** | (2006.01) |
| ***E21B 37/04*** | (2006.01) |
| ***E21B 31/18*** | (2006.01) |
| ***E21B 31/20*** | (2006.01) |

(52) U.S. Cl.

CPC ..... *E21B 31/107* (2013.01); *E21B 31/113* (2013.01); *E21B 31/18* (2013.01); *E21B 31/20* (2013.01); *E21B 37/04* (2013.01)

(56) References Cited

U.S. PATENT DOCUMENTS

| | | | | |
|---|---|---|---|---|
| 2,984,302 | A | 5/1961 | Church | |
| 3,752,230 | A | 8/1973 | Bernat et al. | |
| 4,333,542 | A | 6/1982 | Taylor | |
| 5,228,507 | A | 7/1993 | Obrejanu et al. | |
| 7,073,610 | B2 | 7/2006 | Susman | |
| 8,365,826 | B2 | 2/2013 | Braddick | |
| 2009/0194285 | A1* | 8/2009 | Redlinger | E21B 4/18 166/301 |
| 2011/0030955 | A1 | 2/2011 | Braddick | |

FOREIGN PATENT DOCUMENTS

| | | | |
|---|---|---|---|
| GB | 2556461 | A | 5/2018 |
| WO | WO 2006/116094 | A1 | 11/2006 |
| WO | WO 2008/128543 | A2 | 10/2008 |

OTHER PUBLICATIONS

Intellectual Property Office of the UK Patent Office; Search Report for GB1818933.2; dated Apr. 29, 2019; all pages; Intellectual Property Office of the UK Patent Office, Newport, United Kingdom.

* cited by examiner

SYSTEM AND METHOD FOR MOVING STUCK OBJECTS IN A WELL

The present invention relates to operations performed in a well and in particular, though not exclusively, to a thru-tubing recovery string and method of moving stuck objects in production tubing.

In well operations tools are run on 'strings' into the well bore. The strings may be formed of jointed pipe, coiled tubing, wireline or the like. The strings may be run into open borehole or through tubing present in the well such as casing, lining or other tubing. These may be considered as thru-tubing operations. Tools and techniques have now been developed to run on coiled tubing and wireline to allow through tubing strings to be run into and through the restricted diameter of production tubing. By performing operations through the tubing minimal interruption to a well program is achieved. This allows so-called 'rigless' procedures as a rig is not required to run tools on pipe string saving significant time and costs. These thru-tubing operations may include fishing & pulling activities, cutting, connecting & indexing activities, isolation activities, stimulation activities, etc.

During any operation in a well, objects such as thru-tubing string parts, well tools and other apparatus sometimes become stuck within the well bore and cannot be removed by application of ordinary upward force from surface. When using coiled tubing and wireline the force which can be applied from surface is also restricted. There is also a need to release and move apparatus such as plugs and sliding sleeves which have previously been set in the tubing.

Thru-tubing recovery is currently performed with a hammer tool or jar. Impact hammers, are designed primarily for the installation and/or retrieval of downhole assemblies, for example, nipples. U.S. Pat. No. 7,073,610 describes a hammer tool being a downhole tool for generating a longitudinal mechanical load. In one embodiment, a downhole hammer is disclosed which is activated by applying a load on the hammer and supplying pressurizing fluid to the hammer. The hammer includes a shuttle valve and piston that are moveable between first and further position, seal faces of the shuttle valve and piston being released when the valve and the piston are in their respective further positions, to allow fluid flow through the tool. When the seal is releasing, the piston impacts a remainder of the tool to generate mechanical load. The mechanical load is cyclical by repeated movements of the shuttle valve and piston. This tool can also be used to impart a load on a stuck object and a pulling force to release the object. Such hammer tools are run on coiled tubing being mechanically, by pulling on coiled tubing, and hydraulically, by flow of fluid through hammer, operated. These hammer tools provide a small repeated, sudden or impulse force on the object. The sudden impulse force is of short duration. As the impulse force is relatively small this action may be insufficient to move a stuck object.

A larger force is provided by a jar. This provides a single impact on an object by storing energy and releasing it suddenly. Each jar thus provides a sudden instantaneous impulse force, like the hammer, but this impulse force is much greater than that achieved by the hammer. The jar can reset and the jar action repeated multiple times. U.S. Pat. No. 4,333,542 describes a downhole fishing jar mechanism for freeing stuck objects within a well bore which incorporates a housing structure defining an internal anvil element through which an upwardly-directly impact force is adapted to be transmitted to the body structure. A striker element, incorporated with an elongated operator element is adapted to strike the anvil with an impact force that is controlled by means of an adjustable compression spring. A spherical detente-type latching mechanism is adapted to establish a releasable interconnection with the operator element and further is operative to transmit the compression of the spring to the operator element. The latch mechanism releases automatically upon predetermined upward movement of the operator element and latch mechanism within the body structure, thereby allowing the operator element to move upwardly and cause the striker to impart a predetermined impact force to the anvil. The latch mechanism is capable of being automatically reset upon simple downward movement of the operator element, thus promoting repetitive jarring simply by controlled upward and downward movement of the operator element through actuation of surface-controlled equipment. For a mechanical jar such as this, they are typically operated by raising the string on which the jar is attached. For coiled tubing this means that a portion of the coiled tubing is passed back over the goose neck in the coiled tubing injector head at surface under tension. On firing the jar, the coiled tubing is suddenly drawn back through the goose neck. Repeated operation stresses and wears the coiled tubing at the goose neck causing it to potentially fracture and fail.

Downhole pulling or fishing tools in the form of jacks are also known. US2011030955 describes a hydraulically powered fishing tool for retrieving another tool or tubular stuck in a well. A tool housing is supported in a well on a work string, and the housing encloses a plurality of pistons each movable in response to pressurized fluid transmitted through the work string. An anchor axially fixes the position of the tool in the well, and a tool mandrel is axially movable relative to the tool housing when the anchor is set. A fishing device engages another tool or tubular, so that axial movement of the mandrel in response to the plurality of pistons dislodges the stuck tool or tubular. These pulling tools deliver a static load providing a high force over a period of time and can therefore be considered as a static force. This static force can be used to remove cut sections of casing from a wellbore as described in GB2556461 and incorporated herein by reference.

It is therefore an object of the present invention to provide a thru-tubing recovery string which obviates or mitigates at least one of the disadvantages of prior art thru-tubing recovery strings.

It is a further object of the present invention to provide a method of moving an object in tubing in a well bore which obviates or mitigates at least one of the disadvantages of prior art thru-tubing recovery strings.

According to a first aspect of the present invention there is provided a to thru-tubing recovery string for moving an object in the tubing, comprising:

a bottom hole assembly configured to connect to a work string, the bottom hole assembly including:

a coupling tool configured to attach to the object to be moved;

a first tool configured to apply a first force to the object in order to move the object;

a second tool configured to apply a second force to the object in order to move the object;

wherein:

the first force is an impulse force and the second force is a static force; and the first tool and the second tool operate independently.

In this way, in the event that the first tool provides an insufficient force to dislodge and move the object, the static second force can be applied. The second tool may operate before the first tool, if desired. Additionally, the second force can be a significantly greater force which would otherwise cause damage if applied to the object if only a smaller first force was required to move it. This is especially the case where the object is an actuating member such as a sliding sleeve on an intervention tool, for example.

Preferably, the bottom hole assembly is configured to connect to coiled tubing with the work string being a conduit of coiled tubing. Alternatively, the bottom hole assembly is configured to connect to jointed pipe with the work string being a conduit of jointed. The jointed pipe will preferably of slim design to run in production tubing or other narrow bore tubing in the well.

The first tool may be a hammer tool. In this way, the first force can be applied repeatedly to attempt to dislodge the object.

Alternatively, the first tool may be a jar. In this way, the jar does not need to be repeatedly operated if the object does not move. Instead the second tool can be operated. In this way, the integrity of the coiled tubing is maintained.

Preferably the second tool is a pulling tool. More preferably the second tool is a hydraulically powered pulling tool. Such a tool may be referred to as a hydraulic jack. The second tool may comprise a plurality of fluid actuated stacked pistons which multiply a force available to move an object attached to a lower end of the pistons towards the coiled tubing. In this way, the pulling tool can provide a second force which is much greater than the first force.

The coupling tool may be a fishing tool being one selected from a group comprising: a spear, a grapple and an overshot. In this way, a bottom end of the bottom hole assembly is connected to the object to be moved.

Preferably, the bottom hole assembly includes a hydraulic disconnect. The hydraulic disconnect allows the bottom hole assembly or parts thereof to be parted from the coiled tubing to enable retrieval of the thru-tubing recovery string in the event that the object cannot be moved or that a tool fails. Such hydraulic disconnects are used as an emergency release if the fishing tool cannot be disengaged from the object. The hydraulic disconnect may operate by application of a predefined pressure through the string to activate a release mechanism. Preferably, the hydraulic disconnect operates via a drop ball used to block circulation through the string and enable the application of the release pressure. Preferably the hydraulic disconnect is mounted adjacent the coupling tool on the bottom hole assembly. Preferably also a further hydraulic disconnect is mounted at a top of the bottom hole assembly at the connection to the work string.

Preferably, the bottom hole assembly includes an accelerator. In this way, energy can be stored in the bottom hole assembly for use in operating the first tool.

Preferably, the bottom hole assembly includes an anchor wherein the anchor is set to hold the bottom hole assembly in a fixed position while the second tool is operated.

Preferably, the bottom hole assembly includes a scraper. In this way, the walls of the production tubing can be cleared of any debris in preparation for setting the anchor. More preferably, the scraper is a hydraulically actuated scraper to allow selective cleaning. In this way, scraping need only be performed when required.

In an embodiment, where the first tool is a hammer and the second tool is a pulling tool, the bottom hole assembly may further comprise a third tool, being a jar, providing a third force and wherein the third force is greater than the first force. In this way, an ever increasing force can be used to attempt to move the object, with a greater force being applied when that before was unsuccessful.

In a further embodiment were the first tool is a jar and the second tool is a pulling tool, the bottom hole assembly may further comprise a third tool, being a hammer, providing a third force and wherein the third force is less than the first force. In this way, a vibratory force can be used to try and move the object once a jarring force has been tried. The greater force from the pulling tool can then be used. Alternatively, the tools may be used in any order.

The tubing may be casing, liner or any other tubing present in the well bore. Preferably the tubing is production tubing. Use of a thru-tubing recovery string requires tubing so that tools can be anchored to the tubing through which the recovery string is run.

Preferably the bottom hole assembly has a diameter of 3.5 inches (88.9 mm) or less on run-in. In this way, the thru-tubing recovery string can be deployed in reduced diameter tubing such as production tubing.

According to a second aspect of the present invention there is provided a method of moving an object in tubing in a well bore, comprising the steps:

(a) providing a thru-tubing recovery string according to the first aspect;
(b) connecting the bottom hole assembly of the thru-tubing recovery string to a work string;
(c) running the thru-tubing recovery string through the tubing in the well bore;
(d) attaching the coupling tool to the object;
(e) operating the first tool to apply the first force to the object; and,
(f) operating the second tool to apply the second force to the object.

In this way, an impulse force and a static force can selectively be applied to the object to assist in its movement. Step (e) may be performed before or after step (f). When the second force is greater than the first force, the second force can be applied to move the object so that repeated operation of the first tool is not required.

The method may include repeating steps (e) and (f) until the object moves.

At step (b), the work string may be coiled tubing or jointed pipe.

Preferably the first tool is operated hydraulically by application of fluid pressure through the work string. The first tool may be initially actuated mechanically by pulling of the thru-tubing recovery string at surface. In this way, no electronics or motors are required in the thru-tubing recovery string. The first tool may be a hammer tool or a jar.

Alternatively, the first tool is operated mechanically by manipulation of the work string. The first tool may be a mechanical jar.

Preferably the second tool is operated hydraulically by application of fluid pressure through the work string. The second tool may be initially actuated mechanically by pulling of the thru-tubing recovery string at surface. In this way, no electronics or motors are required in the thru-tubing recovery string. Preferably the second tool is a pulling tool or jack.

Preferably, an anchor on the bottom hole assembly is set in the tubing for operation of the second tool. In this way, tension is not placed on a work string of coiled tubing, at the goose neck when the second force is applied.

The method may include the step of cleaning an inner surface of the tubing. Preferably the step of cleaning includes hydraulically operating a scraper while moving the bottom hole assembly in the tubing and circulating fluid through the bottom hole assembly.

The method may include the step of pulling the thru-tubing recovery string to remove the object from the well. In this way, stuck tools and plugs may be removed from production tubing. Alternatively, the method may include the step of moving the object so as to actuate another tool present in the tubing. In this way, a sliding sleeve may be moved on a tool present in the tubing.

The method may include a further step between steps (e) and (f) wherein the further step comprises operating a third tool to apply a third force to the object wherein the third force applies an impulse force which is greater than the first force and the first tool is a hammer tool, the second tool is a pulling tool and the third tool is a jar. In this way, incremental levels of force can be applied to move the object.

The method may include a further step between steps (e) and (f) wherein the further step comprises operating a third tool to apply a third force to the object wherein the third force applies an impulse force which is less than the first force and the first tool is a jar, the second tool is a pulling tool and the third tool is a hammer tool. In this way, if the initial jar does not move the object a vibratory action from the hammer may dislodge the object so that it can be pulled by the pulling tool.

The tubing may be casing, liner or any other tubing present in the well bore. Preferably the tubing is production tubing.

In the description that follows, the drawings are not necessarily to scale. Certain features of the invention may be shown exaggerated in scale or in somewhat schematic form, and some details of conventional elements may not be shown in the interest of clarity and conciseness. It is to be fully recognized that the different teachings of the embodiments discussed below may be employed separately or in any suitable combination to produce the desired results.

Accordingly, the drawings and descriptions are to be regarded as illustrative in nature, and not as restrictive. Furthermore, the terminology and phraseology used herein is solely used for descriptive purposes and should not be construed as limiting in scope. Language such as "including," "comprising," "having," "containing," or "involving," and variations thereof, is intended to be broad and encompass the subject matter listed thereafter, equivalents, and additional subject matter not recited, and is not intended to exclude other additives, components, integers or steps. Likewise, the term "comprising" is considered synonymous with the terms "including" or "containing" for applicable legal purposes.

All numerical values in this disclosure are understood as being modified by "about". All singular forms of elements, or any other components described herein including (without limitations) components of the apparatus are understood to include plural forms thereof.

Embodiments of the present invention will now be described, by way of example only, with reference to the accompanying drawings of which:

Figure 1:
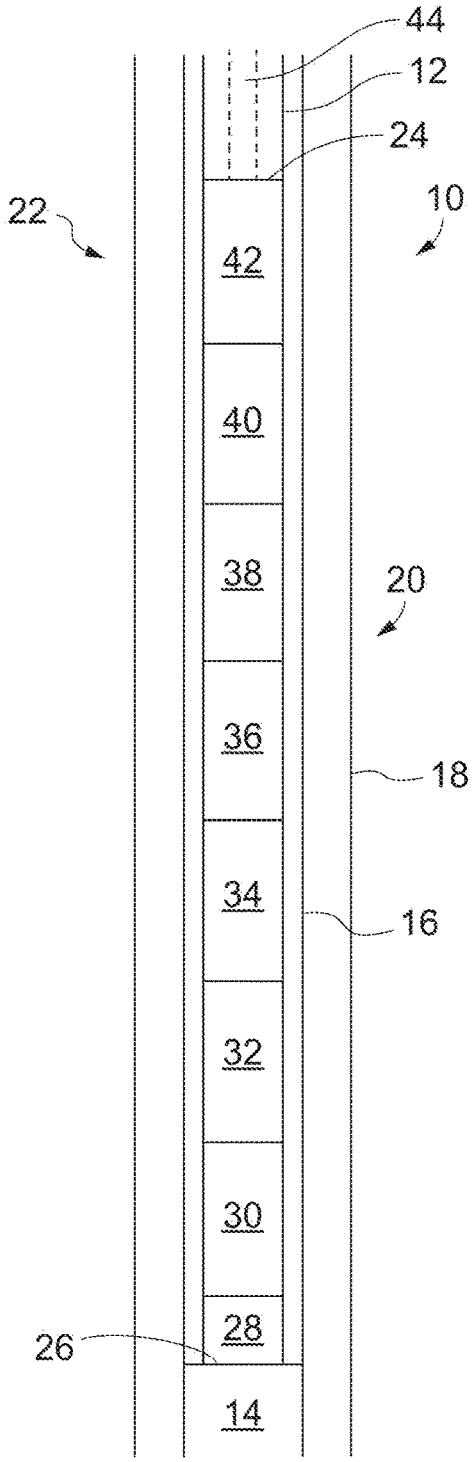
FIG. 1 is a schematic illustration of a thru-tubing recovery string according to an embodiment of the present invention.
Figure 5:
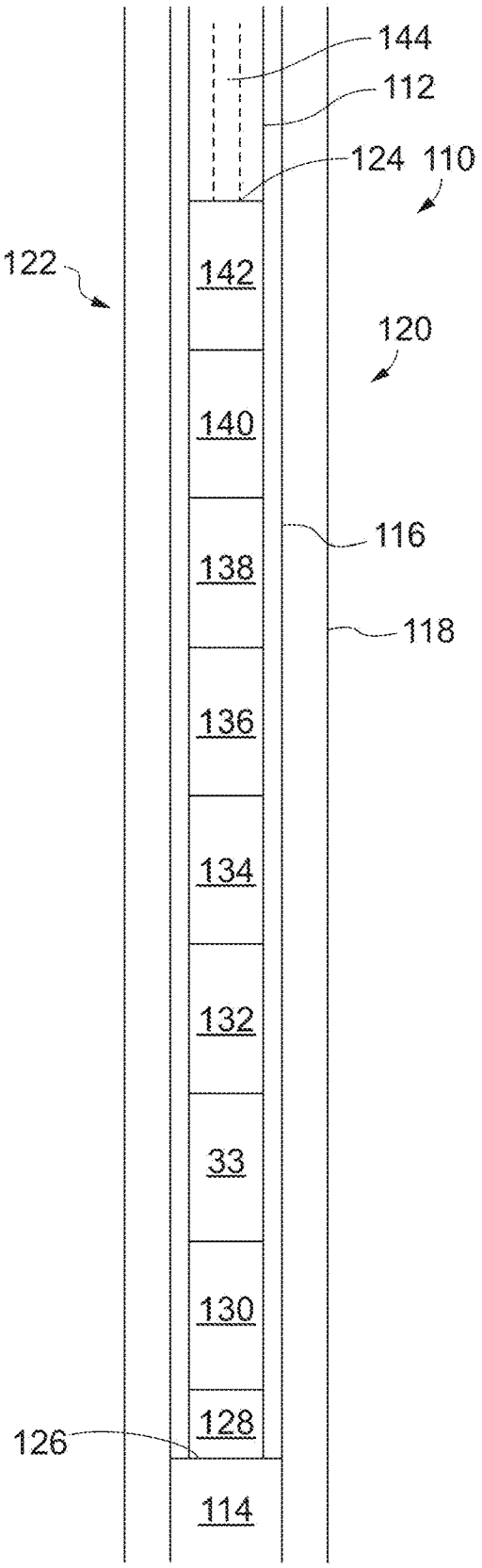
Figure 4A:
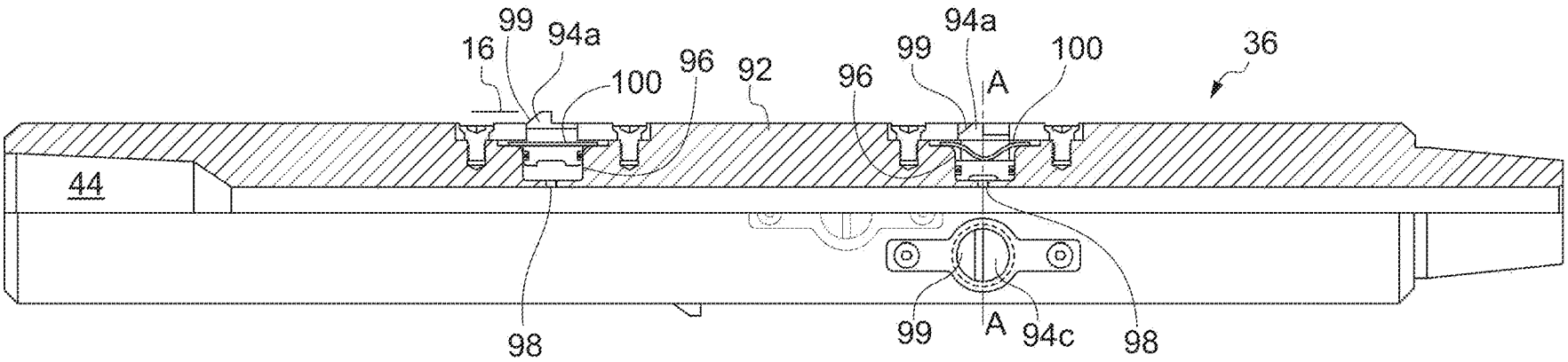
Figure 4B:
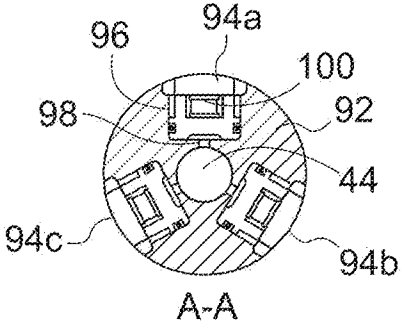

FIGS. 3(*a*)-(*c*) are cross-sectional views through an anchor shown in (a) run-in configuration; (b) first tool operating configuration; and (c) second tool operating configuration with FIG. 3(*d*) being a schematic illustration of a keyed profile of the anchor of FIGS. 3(*a*)-(*c*), for use in the thru-tubing recovery string of FIG. 1;

FIGS. 4(*a*)-(*b*) are (a) part cross-sectional view and (b) cross-sectional view through a scraper for use in the thru-tubing recovery string of FIG. 1; and FIG. 5 is a schematic illustration of a thru-tubing recovery string according to a further embodiment of the present invention.

Referring initially to FIG. 1 of the drawings there is illustrated a thru-tubing recovery string, generally indicated by reference numeral 10, for running on a work string 12 to move an object 14 in the tubing 16, according to an embodiment of the present invention. The tubing may be casing, liner or any other tubing present in the well bore.

The tubing 16 is preferably small bore tubing, say 4.5 inches (114.3 mm) in diameter typical of production tubing run inside liner 18 or casing in a well 20. The work string 12 is a tubular conduit as is known in the art and is preferably coiled tubing but may be jointed pipe having an outer diameter sized to pass through the tubing 16.

The thru-tubing recovery string 10 includes a bottom hole assembly 22 which is coupled to a first end 24 of coiled tubing 12 run from the surface of the well 20 as is known in the art. The use of coiled tubing 12 allows deployment from a floating vessel as is known in the art and removes the requirement for a rig to be brought to the well 20. Such an arrangement is found in completions and intervention work allowing operations on the well 20 to be performed without removing the production tubing.

The bottom hole assembly 22 includes, in order from a first end 26: a coupling tool 28 configured to attach to the object 14 to be moved; a disconnect 30; a first tool 32 configured to apply a first force to the object 14 in order to move the object 14; a second tool 34 configured to apply a second force to the object 14 in order to move the object 14; a scraper 36; an anchor 38; an accelerator 40 and a further disconnect 42. Parts may be formed integrally on a single tool body or may be constructed separately and joined together by box and pin sections as is known in the art. The order may be varied as long as it does not affect the overall operation of the bottom hole assembly 22 and some parts are optional, such as the scraper 36 and the number of disconnects 30,42. All parts are operated mechanically or hydraulically so that no electrical connections are required. Operation is by varying flow rate of fluid pumped through the bore 44 of the coiled tubing 12 which bore extends through the parts of the bottom hole assembly 22, and by tension and release of the coiled tubing 12 string at surface.

The coupling tool 28 may be any fishing tool as is known in the industry. Spears, grapples and/or overshots can be used and choice may be dependent upon the type and position of the object 14 which needs to be moved. The object 14 may be thru-tubing string parts, well tools and other apparatus which have become stuck within the well bore. Alternatively, the object 14 may be a component part which needs to be released to move such as plugs and sliding sleeves which have previously been set in the tubing 16. It will be appreciated that this is a non-exhaustive list of possible objects 14.

The first tool 32 is a hammer tool or a jar as are known in the art. The hammer tool operates by application of a small load typically by tensioning from a pull at surface and then flow through the bore 44 activates a shuttle valve which cyclically raises and releases an anvil or hammer to create an impact on a surface. The force of this impact is transmitted to through the assembly 22 to the object 14. The force of each strike is relatively small, but it is repeated continuously as the shuttle valve is moved up and down. The force is considered as an impulse force as each strike is instantaneous, sudden and of short duration. An example of a hammer tool is disclosed in U.S. Pat. No. 7,073,610, incorporated herein by reference.

Jars are known which, typically by application of tension on the string 10, can store energy up on a compression spring which is released to cause a sudden impact of an anvil. The impulse force applied on impact being greater than the force of a single impact of a hammer tool, but the jar needs to be 're-cocked' to impart a second blow. An example of a jar is as described in U.S. Pat. No. 4,333,542 and incorporated herein by reference.

In conjunction with a jar or hammer tool, an accelerator 40 may be included. Accelerators 40 are known to provide an enhancement to the action of the jar and thus increase the force applied. The accelerator 40 is typically mechanically operated and located above the jar in the bottom hole assembly 22.

Figure 2:
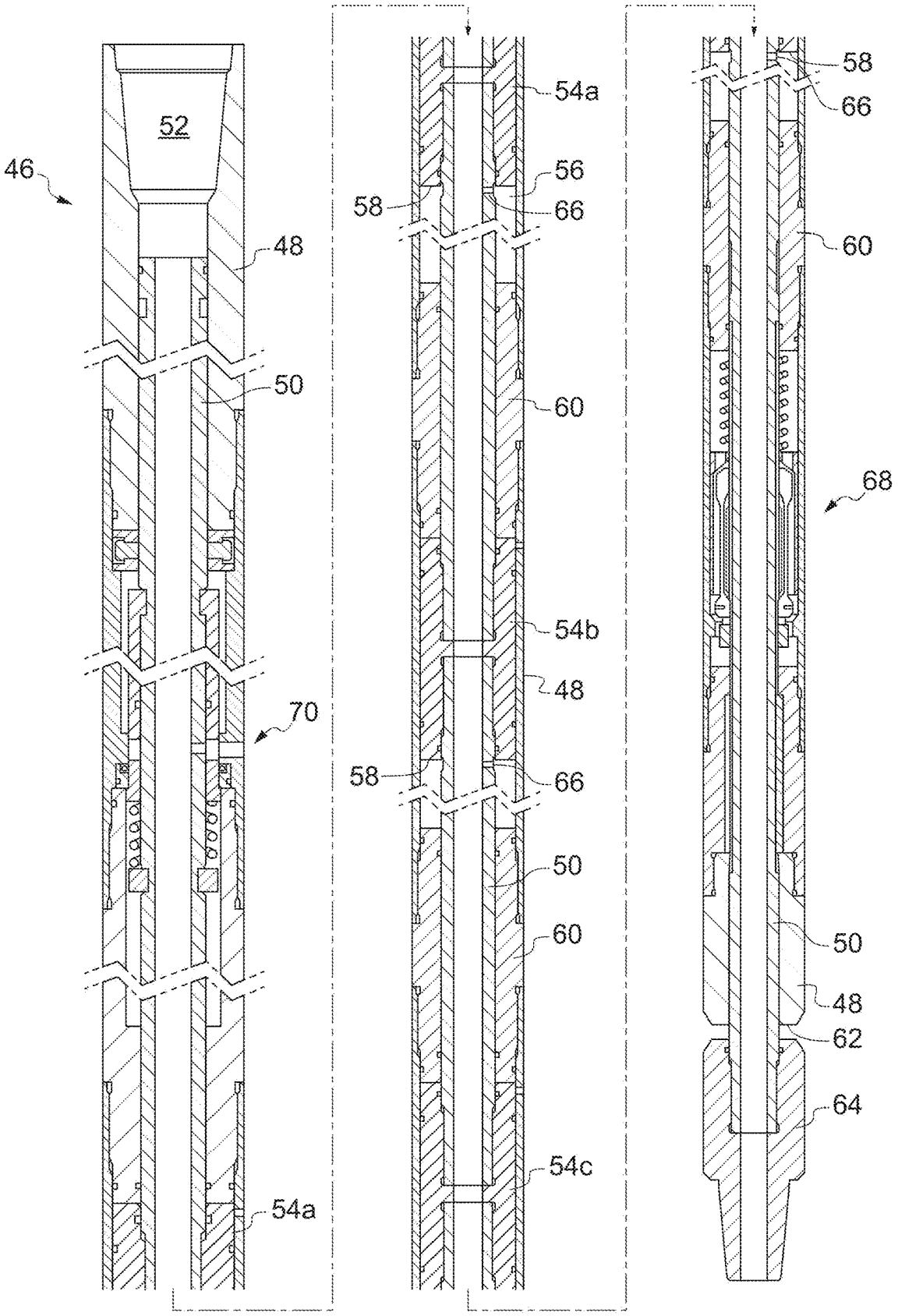
FIG. 2 is a cross-sectional view through a pulling tool for use in the thru-tubing recovery string of FIG. 1.
Figure 3A:
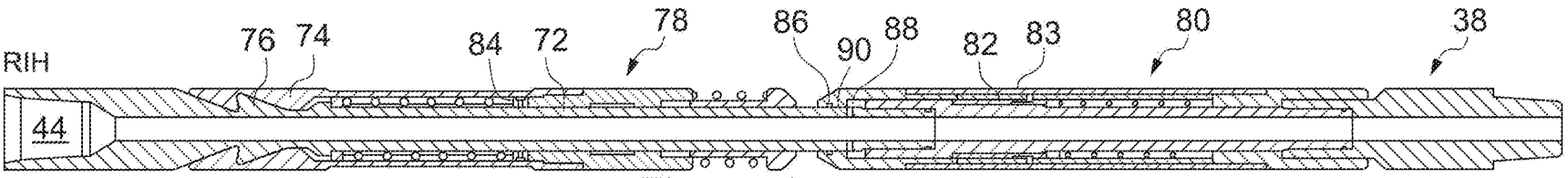
Figure 3B:
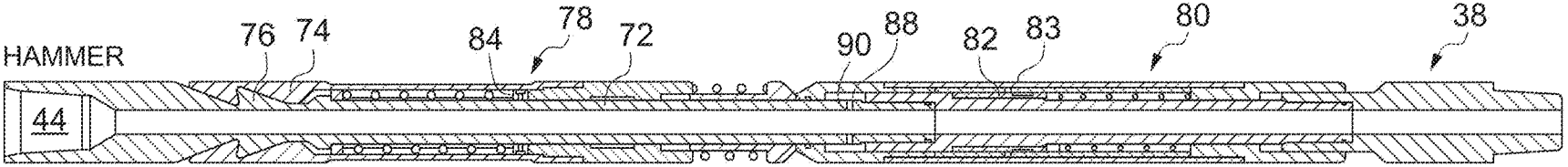
Figure 3C:
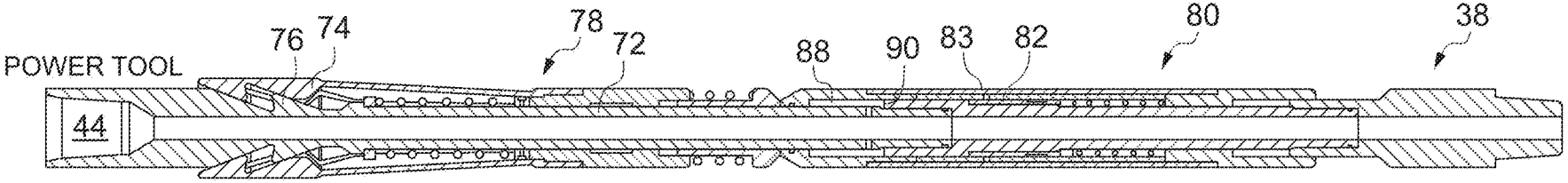
Figure 3D:
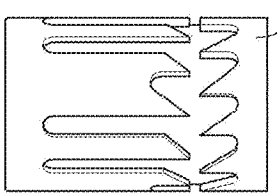

The second tool 34 is a pulling tool. These may be referred to as jacks. A suitable design of a pulling tool 46 is shown in FIG. 2. This design of pulling tool 46 is adapted to provide an outer diameter of less than 4.5 inches (114.3 mm) to be deployed through production tubing. The pulling tool 46 is based on the power section of the hydraulically powered fishing tool as described in U.S. Pat. No. 8,365,826 and incorporated herein by reference.

Pulling tool 46 comprises an outer housing 48 with an upper connection to another part in the bottom hole assembly 22. A mandrel 50 is located in the bore 52 of the housing 48 with a series of pistons 54 mounted on the mandrel 50 extending over an annular bore 56 between the mandrel 50 and the housing 48. While only three pistons 54*a-c* are shown there may by any number to cause sufficient force increase based on the combined surface area of the faces 58 of each piston. The outer housing 48 includes stops 60 arranged in the annular bore 56 between the pistons 54. The mandrel 50 extends from the lower end 62 of the housing 48 and includes a coupling piece 64 to attach the mandrel 50 to a lower part of the bottom hole assembly 22. Ports 66 through the mandrel 50 allow fluid under pressure to be entered between the piston faces 58 and stops 60 to thereby move the pistons 54 and with them the mandrel 50 upwards in the bore 52. This pulls those parts of the bottom hole assembly 22 connected to the coupling piece 64 upwards towards the outer housing 48. The pulling tool 46 also includes a locking mechanism 68 to prevent movement of the mandrel 50 relative to the housing 48 until the tool is required to be used, the locking mechanism being resettable in the well 20. Further, the pulling tool 46 includes a signalling mechanism 70 to provide an indication when the tool 46 has stroked and pulled the coupling piece 64 as close to the housing 48 as possible and the tool 46 is fully contracted. As described above the multiple piston surface areas on faces 58 provide a multiplication of the force available for pulling the object 14. A static force is applied through the mandrel 50 to pull the object 14 with the pulling tool 46. This force is much greater than that available from a hammer tool and is of longer duration than that of a jar as used in the first tool 32.

It will be appreciated that to operate the pulling tool 46, the outer housing 48 must be anchored to the tubing 16. As the outer housing 48 is connected to the work string 10 and the parts of the bottom hole assembly 22 above the pulling tool 46, an anchor can be located on the bottom hole assembly 22 at any suitable position above the pulling tool 46 and work independently of the pulling tool 46.

A suitable anchor 38 is illustrated in FIG. 3(*a*). The anchor 38 has a central mandrel 72 whose ends are standard box and pin sections for connection into the bottom hole assembly 22. Slips 74 are arranged at wedges 76 on the outer surface of the mandrel 72 and a sprung housing 78 used to force the slips 74 outwards by riding over the wedges 76. A second sprung housing 80 is located below the first sprung housing 78 and arranged to act thereupon. Movement of the second sprung housing 80 is controlled via a keyed profile 82, see FIG. 3(*d*), and key pin 83 arrangement between the mandrel 72 and the second sprung housing 80. When run-in the anchor 38 is set in the configuration shown in FIG. 3(*a*), the slips 72 are retracted, both sprung housings 78,80 are held apart and to the mandrel 72 by shear pins 84,86. Fluid from the bore 44 can access a chamber 88 in the second sprung housing via a port 90 in the mandrel 72, but the pressure created is insufficient to shear the pin 86. When the first tool 32 or indeed any tool in the bottom hole assembly 22 is operated, pressure in the bore 44 is increased, pin 86 shears and the second sprung housing 80 moves relative to the mandrel 72 towards the first sprung housing 78. Its distance of travel is controlled by the key pin 83 position in the keyed profile 82 as is known in the art. The distance of travel is insufficient to for the second sprung housing 80 to act on the first sprung housing 78. This is as illustrated in FIG. 3(*b*). When the slips 74 require to engage an inner surface of the tubing 16 and hold the bottom hole assembly 22 in a static position, fluid flow is varied through the bore 44. A small drop in pressure is sufficient to move the key pin 83 around the keyed profile 82. When the key pin 83 enters a channel on the keyed profile 82 which allows further movement of the second sprung housing 80, the second sprung housing 80 will contact the first sprung housing 78, the pin 84 will shear and the slips 74 are released to move up the wedges 76 and thereby extend to contact the inner wall of the tubing 16 and anchor thereto. By maintaining pressure flow through the anchor 38, the anchor can remain set as shown in FIG. 3(*c*). 34 when a pulling tool 46 can now be operated. By dropping pressure, the key pin 83 moves around the keyed profile 82, the slips 74 are retracted and the anchor 38 moves back to the unset configuration shown in FIG. 3(*b*). As the keyed profile 82 is continuous, the anchor 38 can be switched between the set and unset configurations any number of times while in the tubing 16.

Disconnects 30,42 are mounted in the bottom hole assembly 22 as are known in the art. These are hydraulic disconnects which allow the bottom hole assembly 22 or parts thereof to be parted from the coiled tubing to enable retrieval of the thru-tubing recovery string 10 in the event that the object 14 cannot be moved or that a tool in the bottom hole assembly 22 fails. The hydraulic disconnects 30,42 can operate by application of a predefined pressure through the bore 44 to activate a release mechanism or via a drop ball used to block circulation through the bore 44 and enable the application of the release pressure.

The bottom hole assembly 22 may optionally include a cleaning tool. The cleaning tool is used to clean an inner wall of the tubing 16 so that the anchor 38 will set correctly. In the embodiment shown in FIG. 1, the cleaning tool is a scraper 36. The scraper 36 is a hydraulically actuated scraper to allow selective cleaning. An embodiment of a scraper 36 is shown in FIGS. 4(*a*) and 4(*b*). Scraper 36 has a cylindrical body 92 with the standard box and pin sections at each end for mounting the scraper 36 in the bottom hole assembly 22. Sprung scraper blades 94 are located in recesses 96 circumferentially around the body 92. While three blades 94*a-c* are shown in FIG. 4(*b*) there may be any number and they may be spaced along the body 92. A port 98 from the bore 44 through the body 92 accesses the recess 96 so that fluid pressure in the bore 44 can move the scraper blade 94 radially outwards from the body 92. The scraper blade 94 on the left hand side of FIG. 4(*a*) is shown in the actuated position while the scraper blade 94 on the right hand side is shown in the retracted position. The strength of the spring 100 will determine what fluid pressure is required to operate the scraper 36. With the blades 94 extended, the bottom hole assembly 22 can be raised and lowered to cause scraping and cleaning of the inner wall of the tubing 16.

The blades have a sloped surface 99, so that if they are extended and the thru-tubing recovery string 10 is pulled, it will not stick as a result of the blades 94 meeting nipples, joints or other protrusions on the surface of the inner wall of the tubing 16.

In use, the bottom hole assembly 22 is constructed by connecting the coupling tool 28 to a disconnect 30 which in turn is connected to the first tool 32. The first tool 32 is connected to the second tool 34 which in turn is connected to the scraper 36. The anchor 38 is connected to the scraper 36 and to the accelerator 40 before a final disconnect 42 is connected. The bottom hole assembly 22 is connected to a work string, which in this embodiment is a coiled tubing string, when the final disconnect is connected to the first end 26 of the coiled tubing 12.

In this run-in configuration the slips 74 on the anchor 38 and the scraper blades are both retracted. The mandrel 50 on the pulling tool 46 is fully extended from the lower end 62 of the outer housing 48. The thru-tubing recovery string 10 is then run in the well 20 through the tubing 16 and tagged. Cleaning by scraping may then be performed with the scraper 36 actuated and the bottom hole assembly 22 moved inside the tubing 16 so as to remove debris on the walls of the tubing 16. Fluid is also circulated through the bore 44, out of the first end 26 and up the annulus between the string 10 and tubing 16 to assist in removing the debris and further cleaning the tubing 16. The coupling tool 28 is then attached to the object 14 and the string 10 is fixed at that point in the well 20. Pulling on the string 10 at surface will determine if the object 14 is stuck. Such pulling also allows tension to be placed on the string 10 for the operation of the tools 32,34,38.

If the object 14 is stuck, the first tool 32 is actuated. If the first tool 32 is a hammer tool, an overpull on the string 10 and the circulation of fluid through the bore 44, will set up the cyclic hammering which applies a first force repeatedly to the object 14. This vibratory motion may be sufficient to dislodge material around the object 14 which is preventing its movement. If the object 14 is freed, tension is released on the string 10 and the object 14 can be moved by pulling on the string 10 from surface. The pull may move the object 14 to actuate a tool if the object 14 is an actuating member such as a sliding sleeve. Alternatively, the object 14 may be pulled from the well 20 if the object is a plug or stuck piece of apparatus. If a release of tension is not detected, the first tool 32 is stopped, a pull can be tried again to see if the object 14 has released.

Where the first tool 32 is a jar, an overpull can be used to set the jar and the accelerator 40, if present. A sudden release of energy is created to apply a force on the object 14. This force may be an impact force or a pulling force. While the jar can be reset and further jarring actions performed, this is not necessary as, if the object 14 fails to be released, the second tool 34 can be used. In this way, the portion of the coiled tubing 12 which is located over the goose neck at surface is not repeatedly tensioned as is required for repeated jarring, which could cause fatigue and breakage of the coiled tubing 12.

If the object 14 remains fixed in position, the second tool 34 can be actuated. In a preferred embodiment the second tool is a pulling tool 46. If the first tool 32, being a hammer tool or a jar, does not release the object 14 for movement, then the anchor 38 is set as described with reference to FIGS. 3(*a*) to (*c*). Slips 74 anchor to the tubing 16 to hold the outer housing 48 in place while the inner mandrel 50 is moved upwards by fluid action on the pistons 54. The multiplied force across the pistons 54 creates a large second force which is used to pull the inner mandrel 50 and with it the coupling piece 64 attached through the bottom hole assembly 22 to the coupling tool 28 and the object 14. The object 14 is thus jacked into movement. In the event that the object 14 does not fully release, the first tool 32 and the second tool 34 can be cyclically operated until the object 14 is moved. The use of a large static second force after trying an impulse force first means that the second force can be large enough as to potentially cause damage to a tool or the object 14 if the object was not stuck firmly. The object 14 can thus be moved so as to actuate a tool e.g. a sliding sleeve on a frac sleeve or recovered from the well 20 e.g. plug or stuck tool.

It will be appreciated that the first tool 32 and the second tool 34 can be operated in any order. It may be advantageous to first apply the static force when an object is considered to be large or heavy. The static force will move the object vertically thereby moving it along the tubing. By then applying an impulse force the object can be separated from the tubing so that its passage to the surface is easier.

The disconnects 30,42 are available for use if any part of the bottom hole assembly 22 itself becomes stuck in the tubing 16. Use of the disconnects 30,42 are as known in the art. The lower disconnect 30 may also be used if the object 14 is a stuck object which cannot be moved with the thru-tubing recovery string 10 and therefore needs to be milled out. Alternatively, the lower disconnect 30 may be released once the object 14 has been moved, when the object 14 is an actuating element of a tool. In this way, the coupling tool 28 does not require to have a release mechanism.

In a further embodiment, a third force is applied via a third tool 33. FIG. 5 illustrates a thru-tubing recovery string, generally indicated by reference numeral 110. Like parts to those of FIG. 1 have been given the same reference numeral with the addition of 100. The third tool 33 is now located between the first tool 132 and the lower disconnect 130, though its position may be at any point on the bottom hole assembly 122 to suit its and the other tools operational characteristics. In this embodiment, the first tool 132 is a hammer tool, the second tool 134 is a pulling tool 146 and the third tool 33 is a jar. The tools may then be operated in the order of first, third and second to provide an incremental increase in the force applied to the object 114 to get it to move. In an alternative embodiment, the first tool 132 is the jar, the second tool 134 is the pulling tool 146 and the third tool is the hammer tool. The tools are initially operated in the order of first, third and then second, so that an initially jarring action is used in an attempt to free the object 114 before a cyclic hammering akin to vibration to try and dislodge material around the object 114 which may prevent its movement. Thereafter the increased pulling force of the pulling tool 146 is used to jack the object 114 from its stuck position. If the object 114 is not released by the pulling tool 146, the bottom hole assembly 122 will be cycled between the hammer tool and the pulling tool 146 to try and free the object 114. Further operation of the jar is not performed so as to protect the coiled tubing 12 which is at the goose neck.

The selection of the hammer tool or the jar as the first tool 132 with the other being the third tool 33 can be based on the operational requirements of the both these tools and which would operate best above the other in the string. Each tool 132,134,33 operates independently and thus can be operated in any order as selected by the operator at surface.

It will be appreciated that while only tools are shown connected to each other on the bottom hole assemblies 22,122, tubular sections may be present between the tools to space them out and/or further tools may be incorporated.

The principle advantage of the present invention is that it provides apparatus and method for freeing a stuck object in a well using a thru-tubing recovery string which can apply both an impulse first force and a static second force on the object in order to move the object.

A further advantage of the present invention is that it provides a thru-tubing recovery string which can be used in small diameter production tubing to recover objects and operate tools within the tubing.

A still further advantage of at least one embodiment of the present invention is that it provides a thru-tubing recovery string in which a jar, a hammer tool and a pulling tool can be operated independently, 'on-demand' and repeatedly without requiring electrical connections.

The foregoing description of the invention has been presented for the purposes of illustration and description and is not intended to be exhaustive or to limit the invention to the precise form disclosed. The described embodiments were chosen and described in order to best explain the principles of the invention and its practical application to thereby enable others skilled in the art to best utilise the invention in various embodiments and with various modifications as are suited to the particular use contemplated. Therefore, further modifications or improvements may be incorporated without departing from the scope of the invention herein intended with the invention being defined within the scope of the claims.

I claim:

1. A thru-tubing recovery string for moving an object in a well bore, comprising:

a bottom hole assembly configured to connect to a work string, the bottom hole assembly including:

a coupling tool configured to attach to the object to be moved;

a first tool configured to apply a first force to the object in order to move the object;

a second tool configured to apply a second force to the object in order to move the object;

wherein:

the first force is an impulse force and the second force is a static force; and the first tool and the second tool operate independently.

2. The thru-tubing recovery string according to claim 1 wherein the first tool is a hammer tool.

3. The thru-tubing recovery string according to claim 1 wherein the first tool is a jar.

4. The thru-tubing recovery string according to claim 1 wherein the second tool is a pulling tool.

5. The thru-tubing recovery string according to claim 1 wherein the coupling tool is a fishing tool being one selected from a group comprising: a spear, a grapple and an overshot.

6. The thru-tubing recovery string according to claim 1 wherein the bottom hole assembly includes a hydraulic disconnect.

7. The thru-tubing recovery string according to claim 1 wherein the bottom hole assembly includes an accelerator.

8. The thru-tubing recovery string according to claim 1 wherein the bottom hole assembly includes an anchor wherein the anchor is set to hold the bottom hole assembly in a fixed position while the second tool is operated.

9. The thru-tubing recovery string according to claim 1 wherein the bottom hole assembly includes a scraper.

10. The thru-tubing recovery string according to claim 1 wherein the first tool is a hammer, the second tool is a pulling tool, the bottom hole assembly further comprising a third tool, being a jar, providing a third force and wherein the third force is greater than the first force.

11. The thru-tubing recovery string according to claim 1 wherein the bottom hole assembly has a diameter of 3.5 inches (88.9 mm) or less on run-in.

12. The thru-tubing recovery string according to claim 1 further comprising the work string, the work string being a tubular conduit selected from the group consisting of coiled tubing and jointed pipe.

13. A method of moving an object in a well bore, comprising the steps:

(a) providing a thru-tubing recovery string comprising:

a bottom hole assembly configured to connect to a work string, the bottom hole assembly including:

a coupling tool configured to attach to the object to be moved;

a first tool configured to apply a first force to the object in order to move the object;

a second tool configured to apply a second force to the object in order to move the object;

wherein:

the first force is an impulse force and the second force is a static force; and the first tool and the second tool operate independently;

(b) connecting the bottom hole assembly of the thru-tubing recovery string to the work string;

(c) running the thru-tubing recovery string through tubing in the well bore;

(d) attaching the coupling tool to the object;

(e) operating the first tool to apply the first force to the object; and, (f) operating the second tool to apply the second force to the object.

14. The method of moving an object in a tubular string according to claim 13 wherein the steps (e) and (f) are performed in reverse order.

15. The method of moving an object in a tubing string according to claim 13 wherein the first tool is operated hydraulically by application of fluid pressure through the work string.

16. The method of moving an object in a tubing string according to claim 13 wherein the second tool is operated hydraulically by application of fluid pressure through the work string.

17. The method of moving an object in a tubing string according to claim 13 wherein an anchor on the bottom hole assembly is set in the tubing for operation of the second tool.

18. The method of moving an object in a tubing string according to claim 13 wherein the method includes the step of cleaning an inner surface of the tubing.

19. The method of moving an object in a tubing string according to claim 13 wherein the method includes a further step between steps (e) and (f) wherein the further step comprises operating a third tool to apply a third force to the object wherein the third force is greater than the first force and the first tool is a hammer tool, the second tool is a pulling tool and the) third tool is a jar.

20. The method of moving an object in a tubing string according to claim 13 wherein the method includes a further step between steps (e) and (f) wherein the further step comprises operating a third tool to apply a third force to the object wherein the third force is less than the first force and the first tool is a jar, the second tool is a pulling tool and the third tool is a hammer tool.

* * * * *